US006380920B1

(12) United States Patent
Ozawa

(10) Patent No.: US 6,380,920 B1
(45) Date of Patent: Apr. 30, 2002

(54) ELECTRO-OPTICAL DEVICE DRIVE CIRCUIT, ELECTRO-OPTICAL DEVICE AND ELECTRONIC EQUIPMENT USING THE SAME

(75) Inventor: Tokuro Ozawa, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/419,971

(22) Filed: Oct. 18, 1999

(30) Foreign Application Priority Data

Oct. 16, 1998 (JP) ..... 10-295658

(51) Int. Cl.[7] ..... G09G 3/36
(52) U.S. Cl. ..... 345/100; 345/98; 345/559
(58) Field of Search ..... 345/87–89, 98–100, 345/96, 209, 204, 55, 559

(56) References Cited

U.S. PATENT DOCUMENTS 5,170,158 A 12/1992 Shinya ..... 345/98
6,046,719 A * 4/2000 Dengwau ..... 345/100
6,049,321 A * 12/2000 Sasake ..... 345/99
6,157,360 A * 12/2000 Jeong et al. ..... 345/98
6,160,532 A * 12/2000 Kaburage et al. ..... 345/87

OTHER PUBLICATIONS

Mosley, Alan "The structure, performance and future of passive matrix LCDs" John Wiley & Sons pp. 173–176, 1997.*

* cited by examiner

*Primary Examiner*—Richard Hjerpe
*Assistant Examiner*—Frances Nguyen
(74) *Attorney, Agent, or Firm*—Oliff & Berridge, PLC

(57) ABSTRACT

A drive circuit for an electro-optical device, which has a plurality of pairs of shift registers for latching and holding signals representing bits of image data, a D/A converter for performing D/A-conversion on image data latched by the shift register n-bits by n-bits, for generating voltages corresponding to $2^N$ gray scales and for supplying the generated voltages to signal lines, and a switch group for selectively supplying image data latched by one of the shift registers of each of the pairs to the D/A converter. This drive circuit is adapted to repeatedly perform an operation of supplying the D/A converter with image data held by one of the shift registers of each of the pairs during image data is latched by the other shift register. Thus, image data can be inputted thereto at a high speed.

24 Claims, 13 Drawing Sheets

[FIG. 1]
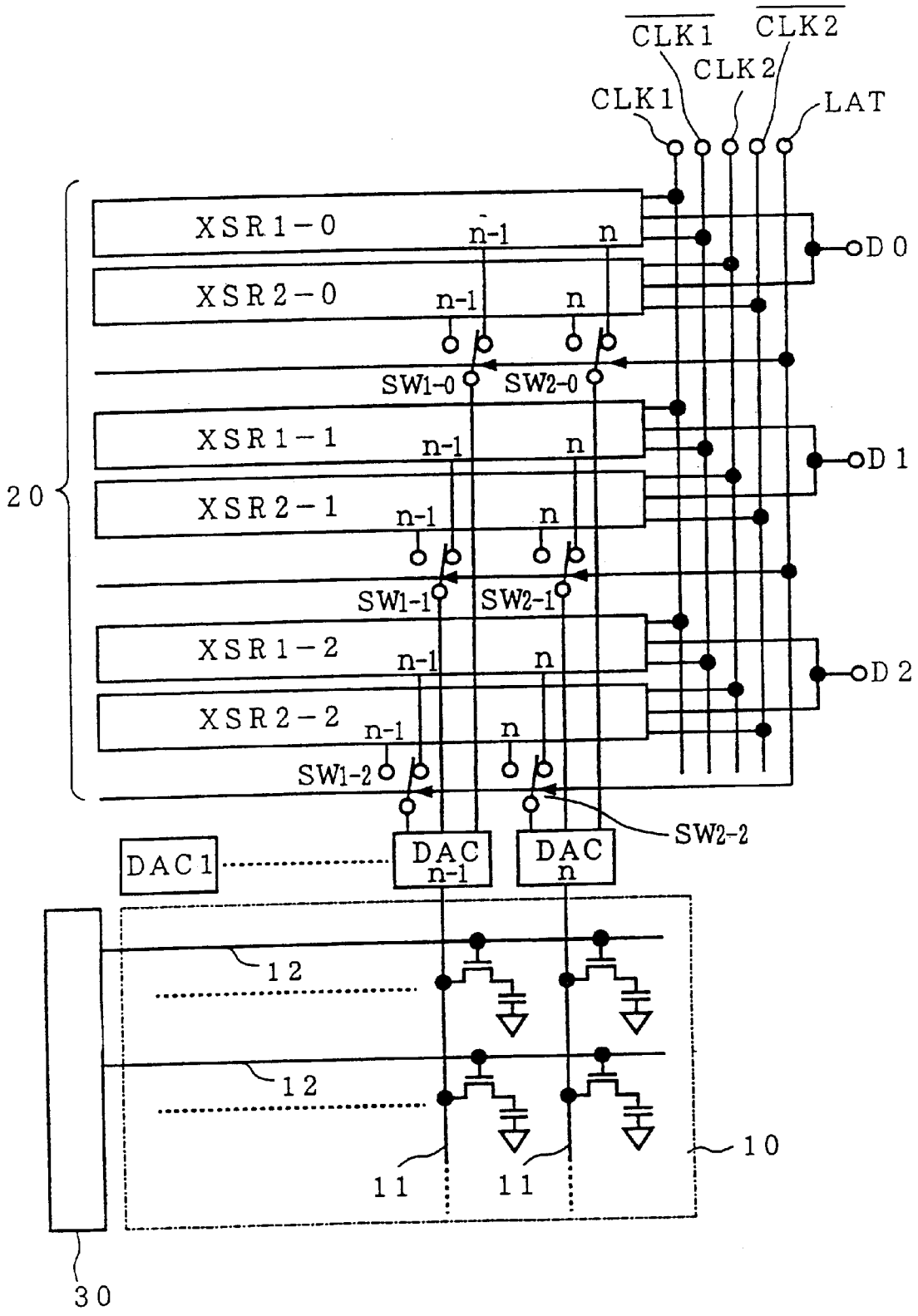
SCANNING LINE DRIVE CIRCUIT

[FIG. 2]
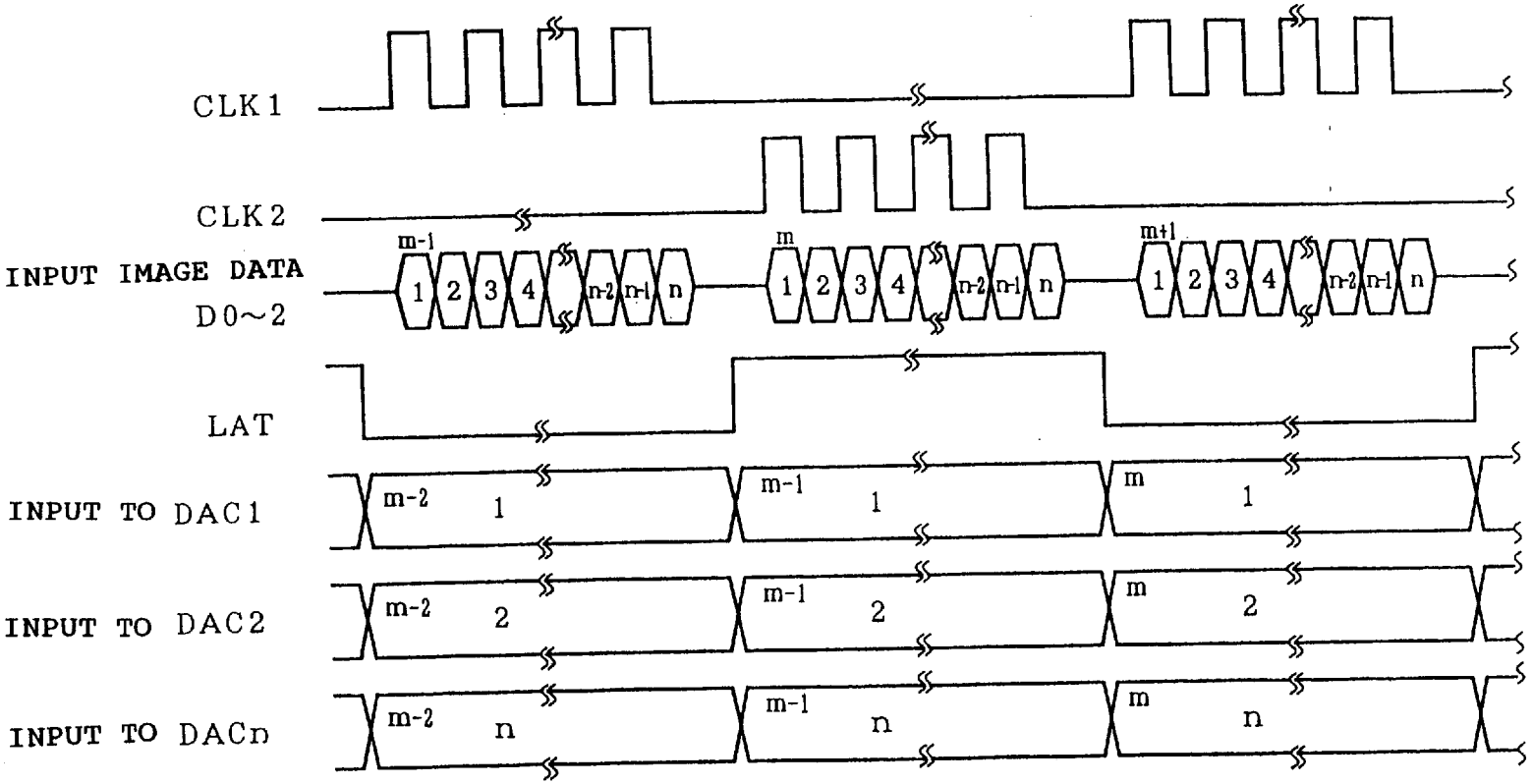

[FIG. 3]
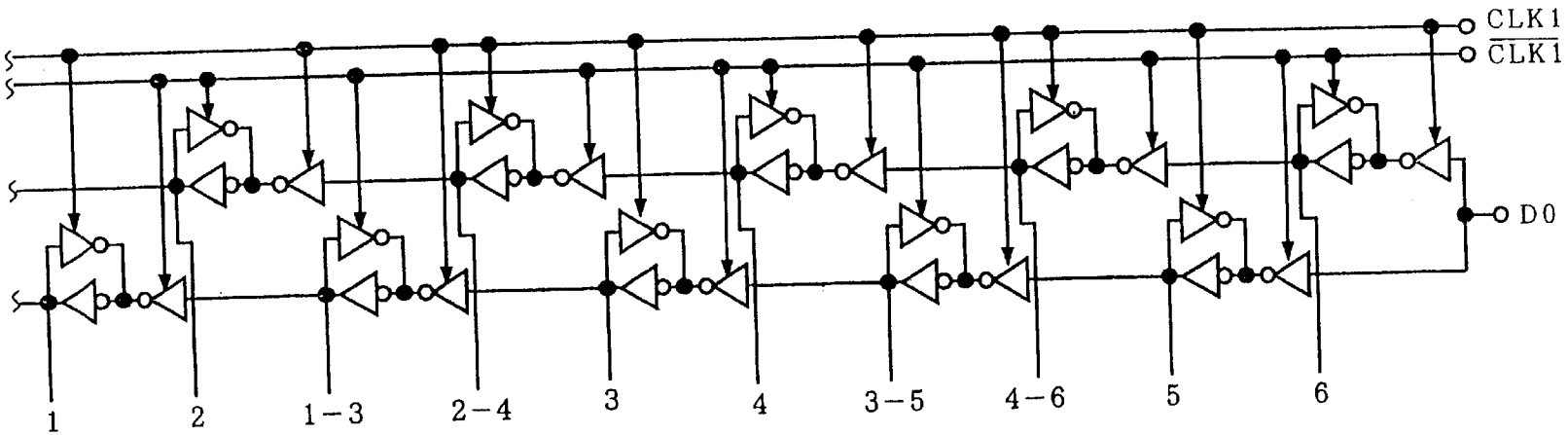

[FIG. 4]
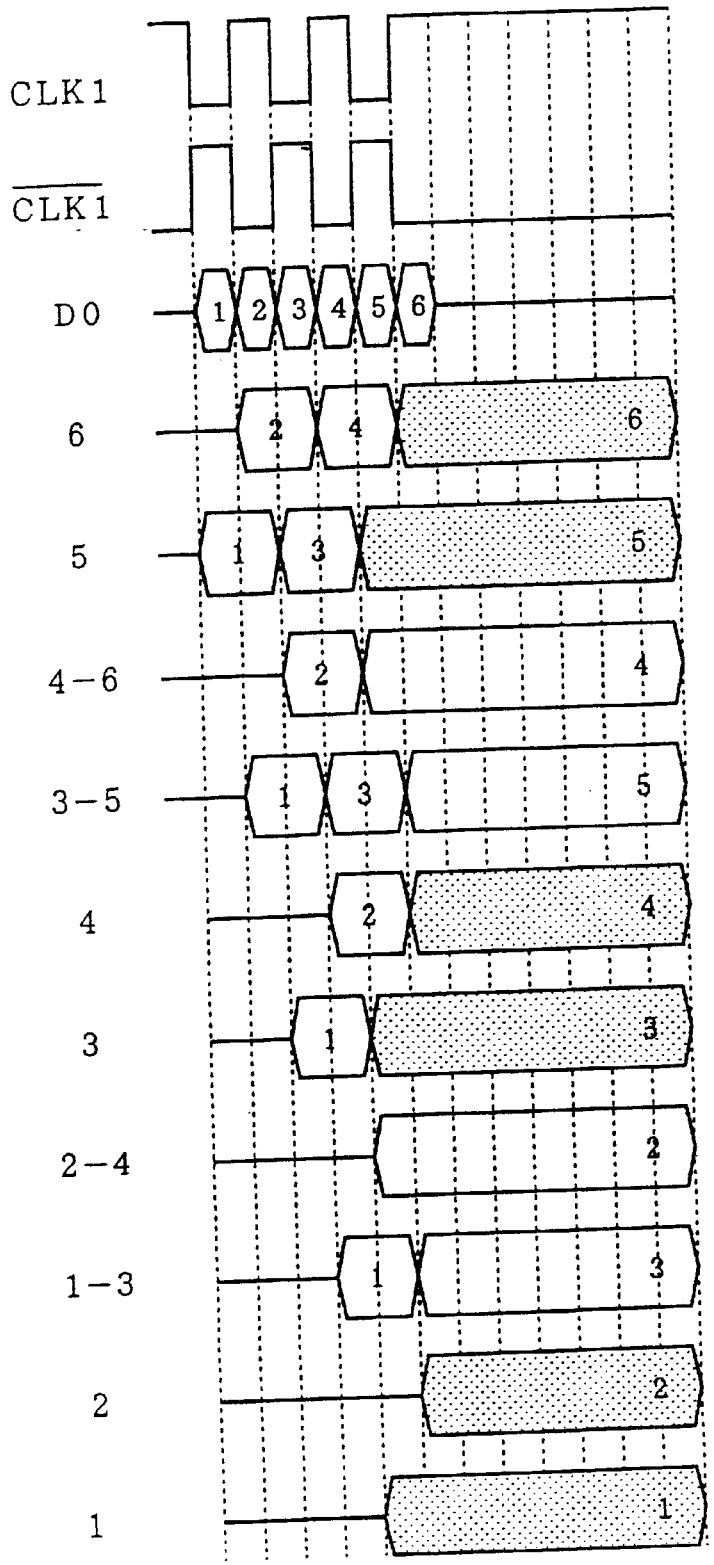

[FIG. 5]
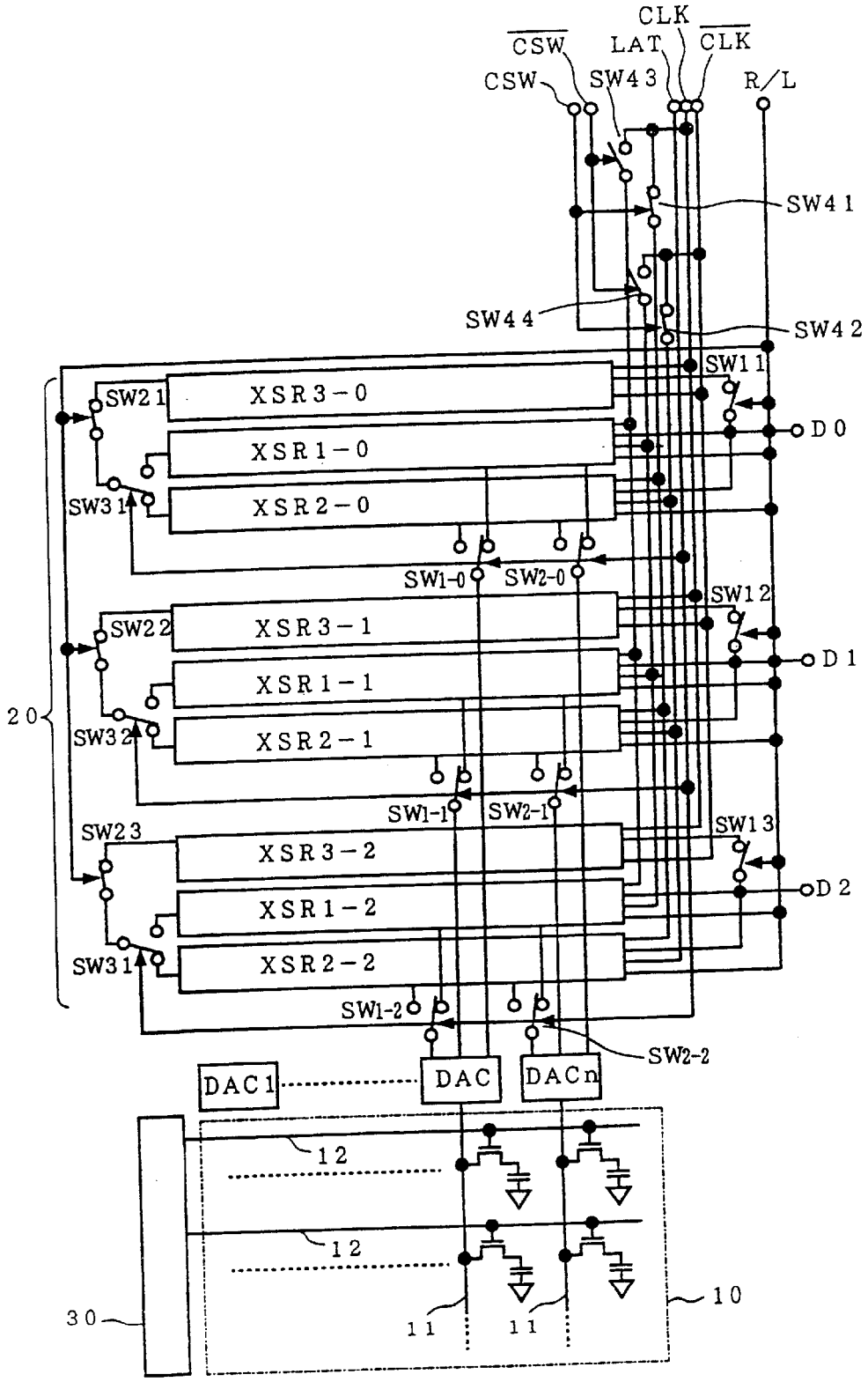
SCANNING LINE DRIVE CIRCUIT

[FIG. 6]
(A)
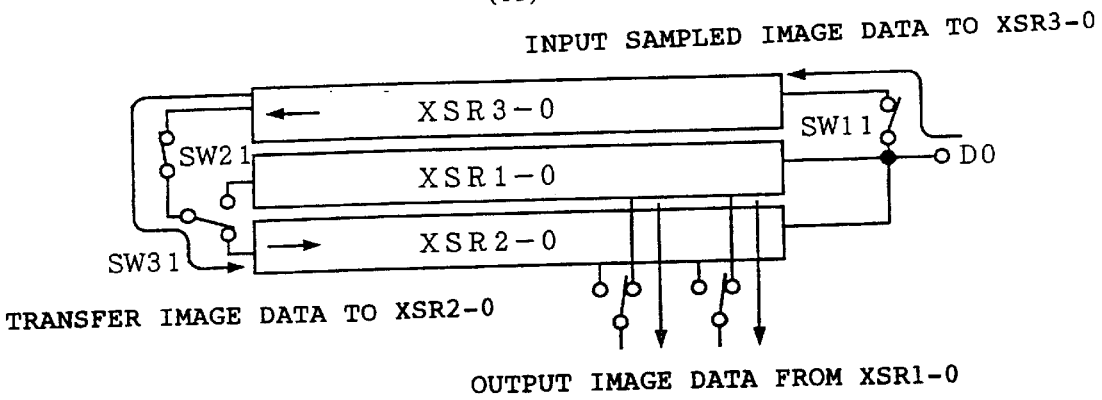
IN CASE OF PERFORMING LATERAL INVERSION
(B)
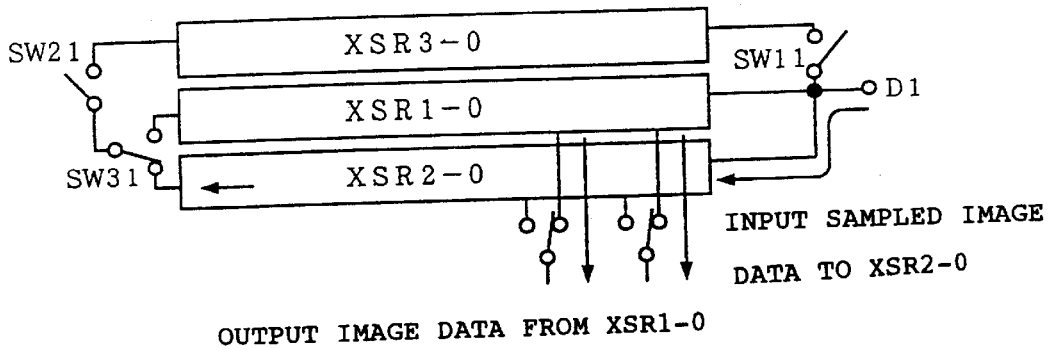
IN CASE OF PERFORMING NO LATERAL INVERSION

[FIG. 7]
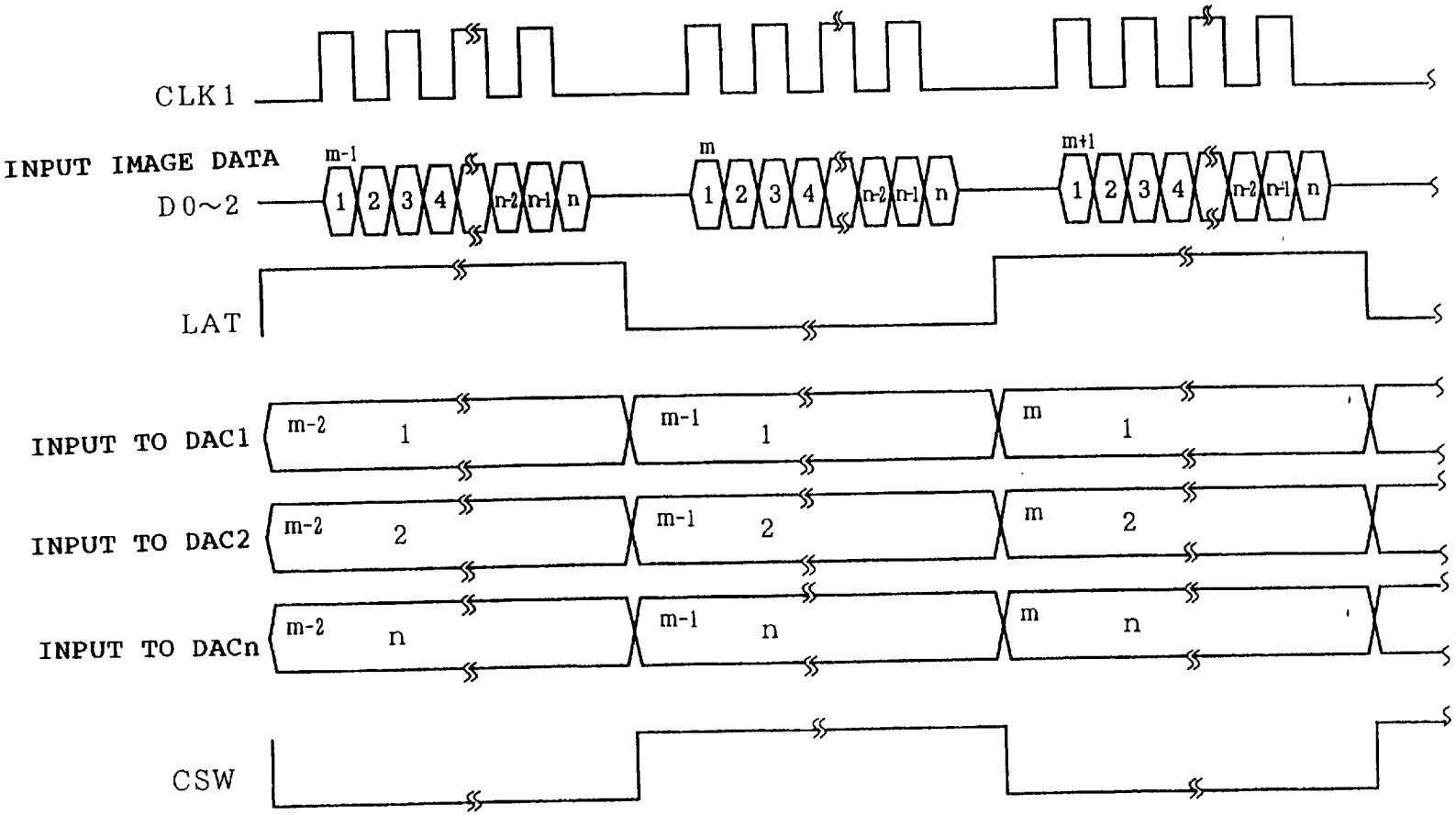

[FIG. 8]
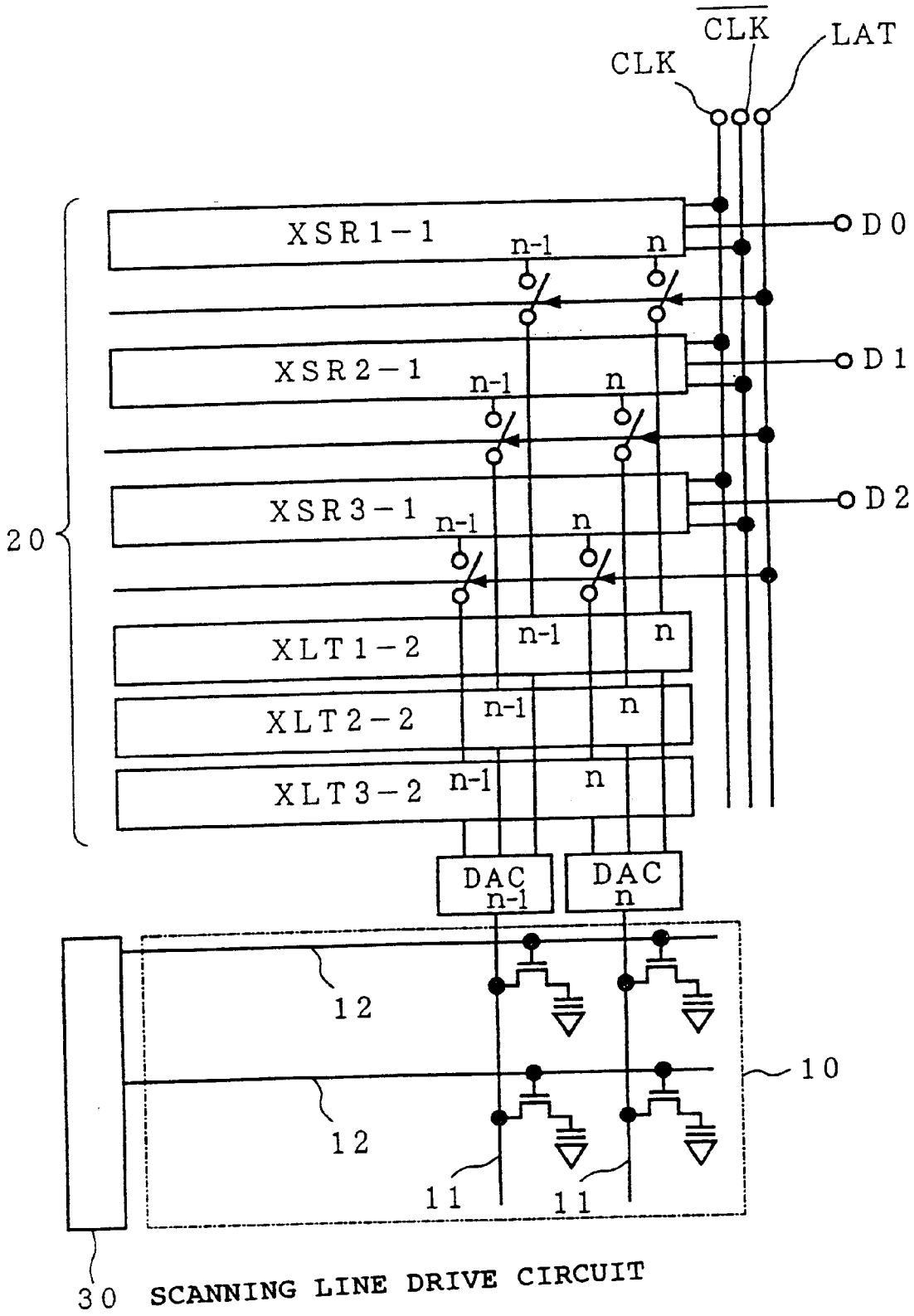

[FIG.9]
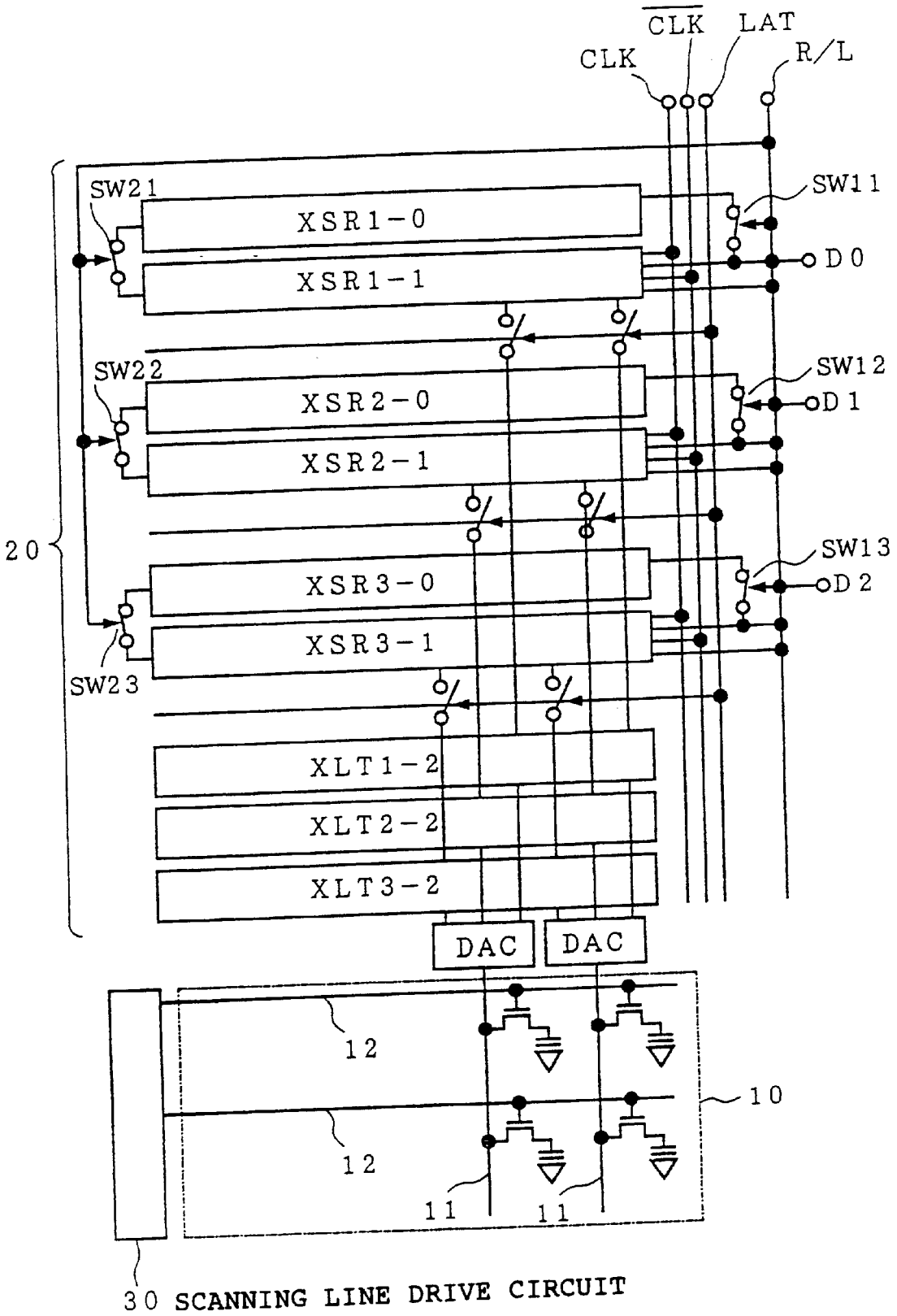

[FIG. 10]
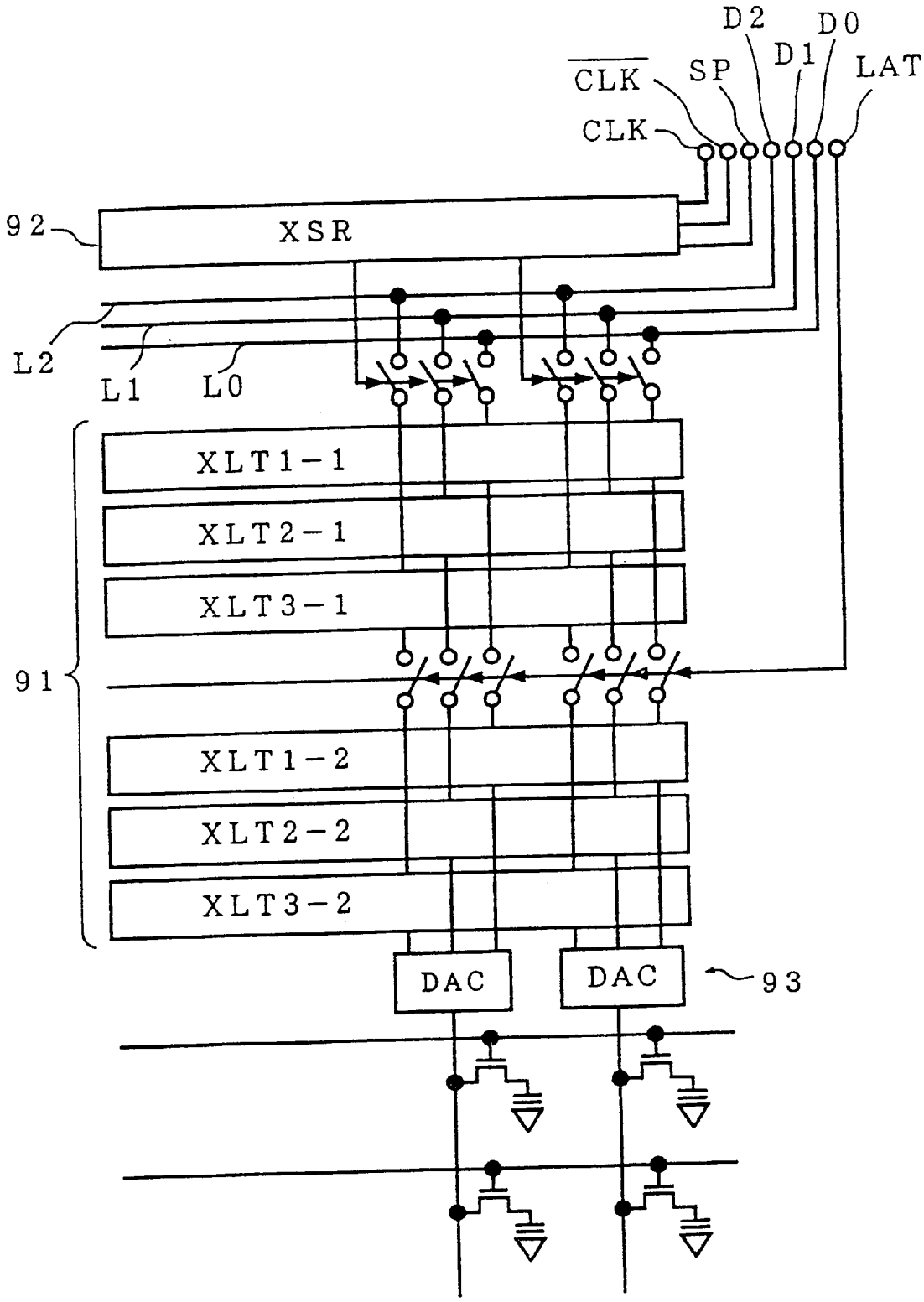

[FIG. 11]
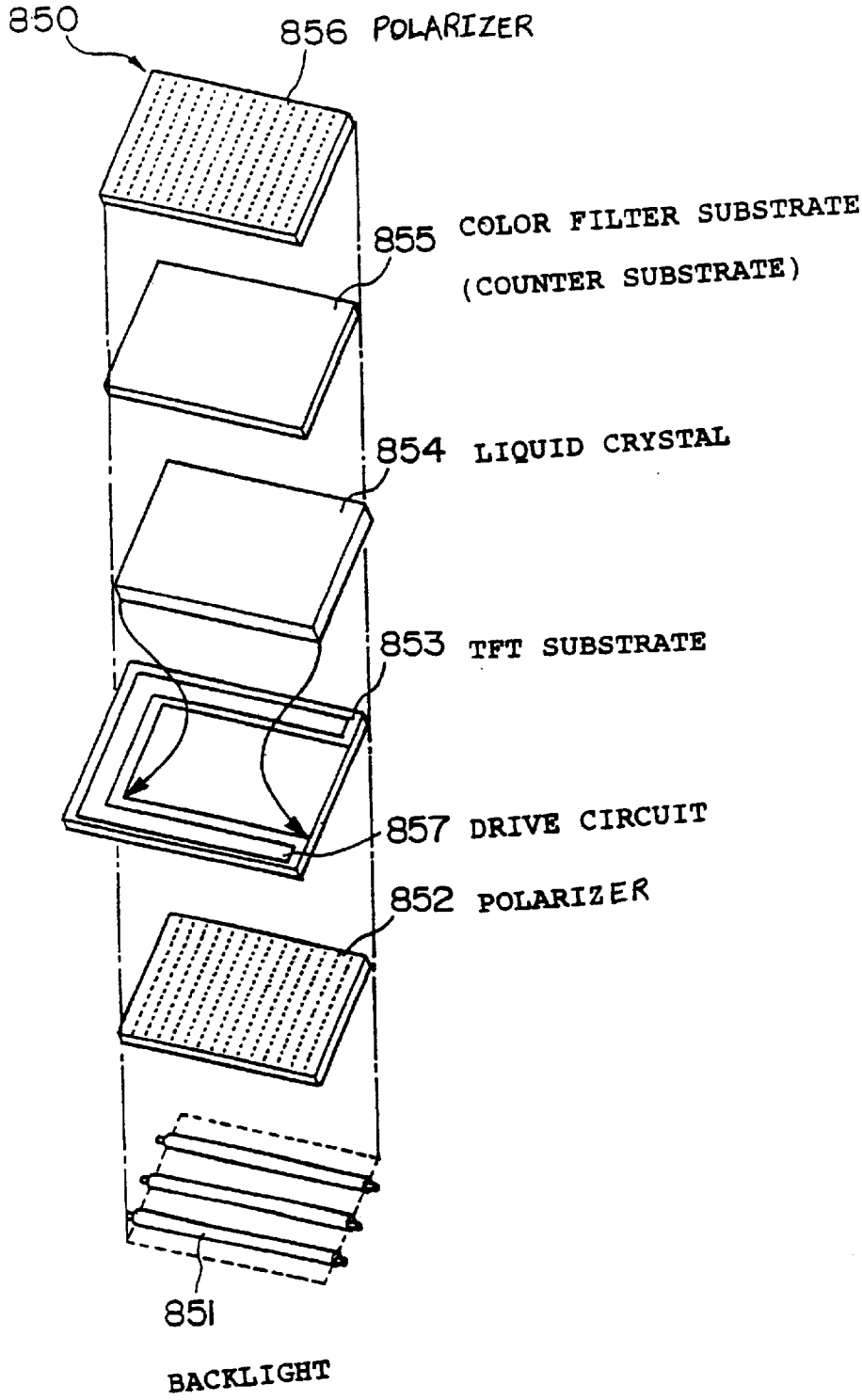

[FIG. 12]
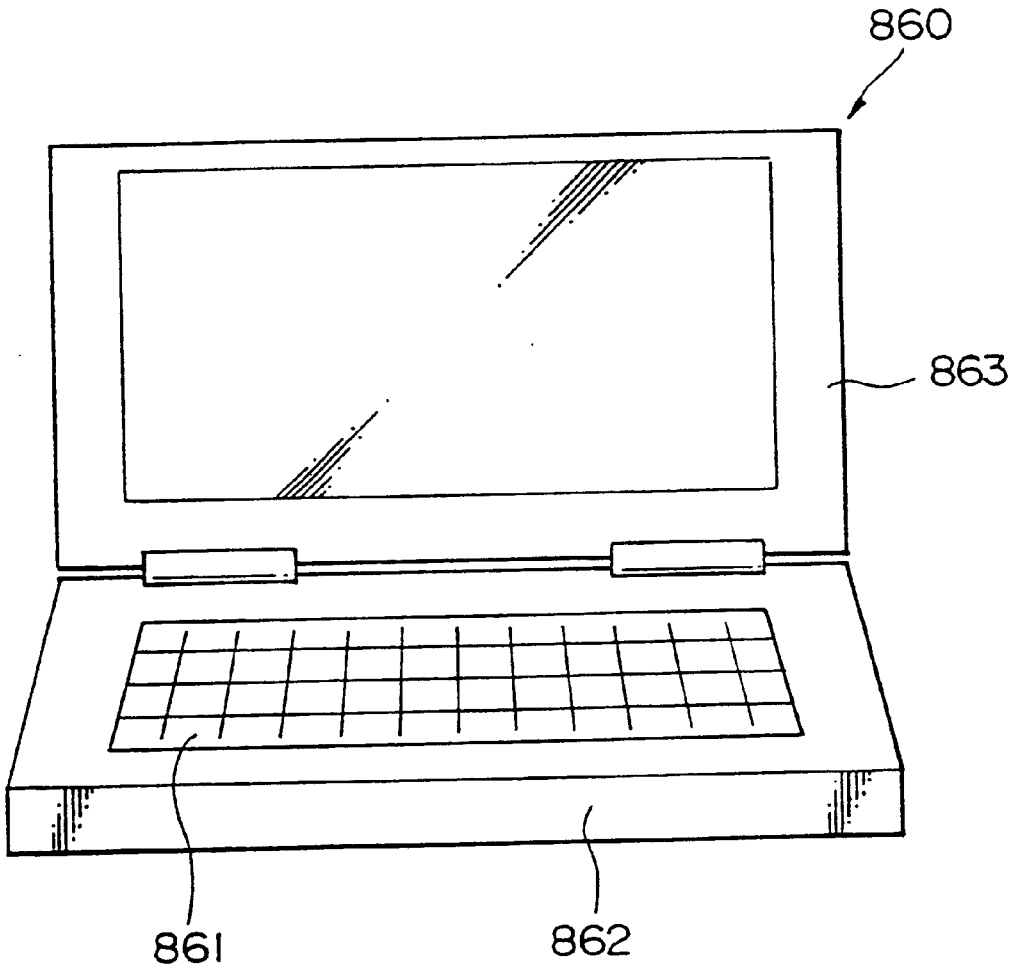

[FIG. 13]
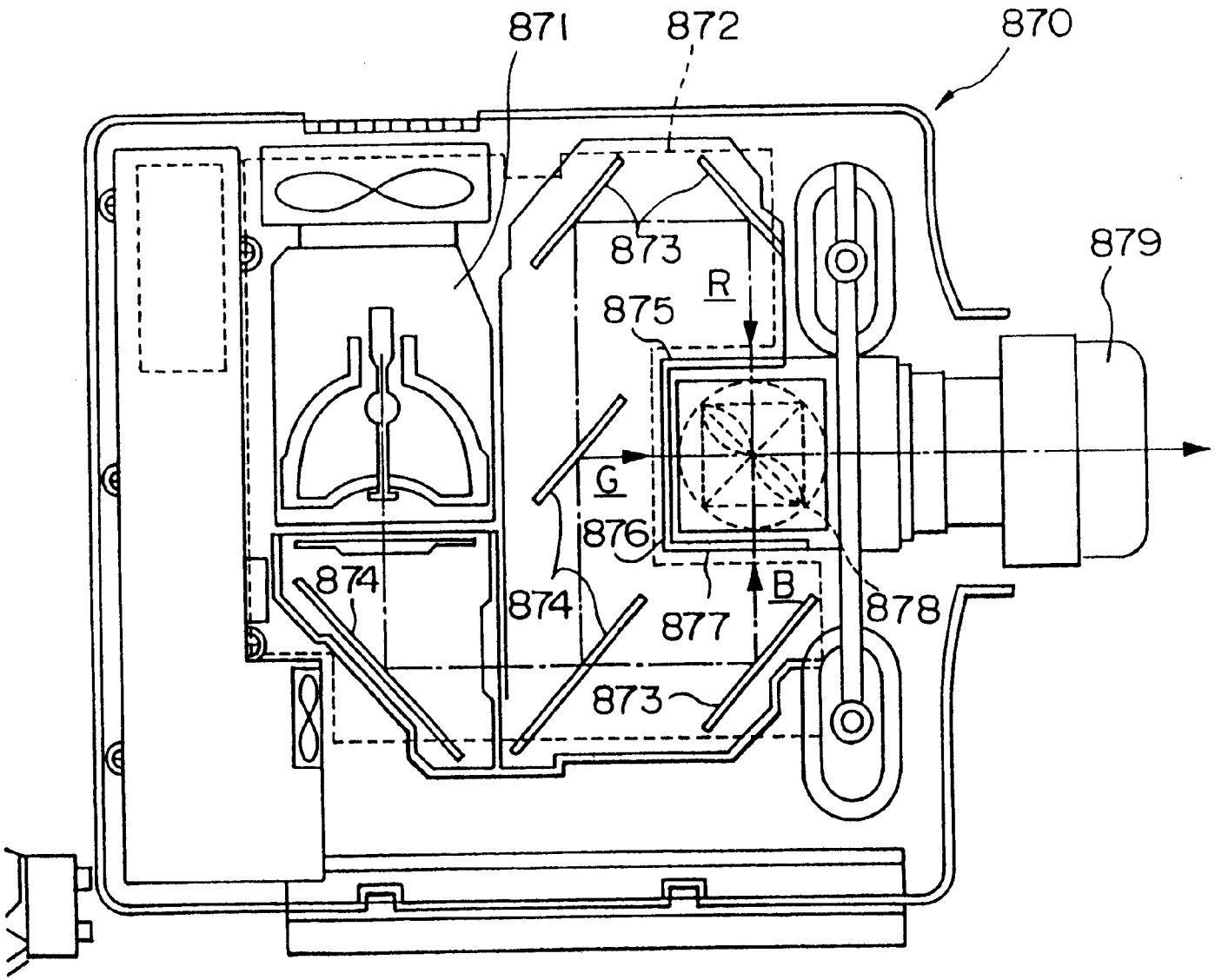

ELECTRO-OPTICAL DEVICE DRIVE CIRCUIT, ELECTRO-OPTICAL DEVICE AND ELECTRONIC EQUIPMENT USING THE SAME

BACKGROUND OF THE INVENTION

1. Field of Invention

The present invention generally relates to a drive circuit for an electro-optical device, and more particularly, to a liquid crystal drive circuit having a D/A converter (namely, a digital-to-analog conversion circuit), and to an electro-optical device using this drive circuit, and to electronic equipment using this electro-optical device for displaying an image.

2. Description of Related Art

As shown in FIG. 10, a conventional drive circuit for an electro-optical device comprises latching means 91 consisting of a first group of latch circuits XLT1-1 to XLT3-1, each of which sequentially latches and holds digital image data (hereunder referred to simply as image data) supplied from an external control device to terminals D0, D1 and D2, and a second group of latch circuits XLT1-2 to XLT3-2, to which image data of one line is latched by the first group of latch circuits. This drive circuit further comprises a shift register 92 for generating clock signals, which provide timing in serially latching image data present on data lines L0, L1 and L2, according to clocks CLK and $\overline{\text{CLK}}$ supplied from an external circuit. This drive circuit furthermore comprises a D/A converter 93 adapted to perform the D/A conversion of data (consisting of 3 bits in the case shown in this figure) of each of pixels respectively represented by the image data latched by the second group of latch circuits XLT1-2 to XLT3-2 for supplying predetermined voltages to each signal line in the pixel region.

In the aforementioned drive circuit, image data are input from an external circuit to the data lines L0, L1 and L2, respectively. However, the parasitic capacitance of the data lines L0, L1 and L2 has an extremely large value (which may be 100 pF or more), in comparison with that of wirings of a semiconductor integrated circuit, because of the facts that the length of the aforementioned data lines L0, L1 and L2 of an electro-optical device reaches several tens of cm and that the electro-optical device has many signal lines intersecting the data lines L0, L1 and L2. Thus, the rate of transmission of image data at a point on each of the data lines L0, L1 and L2 decreases with a reduction in the distance between the point and a tip end thereon, namely, with the distance from a corresponding data input terminal to the point. This results in a decrease in the timing margin of the clock signal providing the first group of latch circuits XLT1-1 through XLT3-1 with data latch timing with which data output from the shift register 92 is latched by the first group of latch circuits XLT1-1 to XLT3-1. Consequently, it becomes difficult to input image data thereto at a high speed.

Further, the output impedance of an IC for outputting image data should be reduced so as to achieve the high-speed input Of image data. However, the large parasitic capacitance of the data lines L0, L1 and L2 makes it extremely difficult to realize the high-speed input of image data. For instance, in the case of a liquid crystal panel having a resolution of 640×480 dots and conforming to the VGA (Video Graphic Array) standard, the frequency of an image data input signal is 20 MHz or so. Moreover, in the case of a liquid crystal panel conforming to the SVGA (Super Video Graphics Array) standard, the frequency of an image data input signal reaches 100 MHz. Therefore, it is difficult to realize the high-speed input of image data. Especially, in the case of an electro-optical device using a polysilicon TFT as an element of a drive circuit, at least 3.3 V, preferably, 5 V or more is needed as the amplitude of a signal representing the aforementioned image data. The driving ability of the IC outputting image data should be enhanced so as to input image data to the data lines having large parasitic capacitance at a high speed by using a signal of a large amplitude.

SUMMARY OF THE INVENTION

The present invention is proposed to solve the aforementioned problems of the conventional drive circuit. Accordingly, the present invention provides a drive circuit for an electro-optical device, to which image data can be input at a high speed from an external circuit.

The present invention also provides a drive circuit for an electro-optical device, which is enabled to lower the driving ability of the IC inputting image data and reduce the power consumption thereof.

The present invention also provides a drive circuit for an electro-optical device, which decreases the wiring pitch of signal lines in a pixel area.

The present invention provides a drive circuit for an electro-optical device having a function of performing lateral inversion of an image, which can perform lateral inversion of an image without having what is called a reverse reading circuit for reading image data of one line in a reverse direction from a memory in which image data is stored.

According to an aspect of the present invention, there is provided a drive circuit for an electro-optical device, which is configured so that the shift register is used for latching image data, instead of generating clock signals providing data latching timing to the latch circuit for latching image data input from an external circuit, differently from the conventional drive circuit.

This results in a decrease in the length of each of the data lines between the corresponding image data input terminal and the shift register for latching image data. Thus, in the case of the drive circuit of the present invention, there is no necessity for considering the timing margin of the clock signal providing each of the latch circuits with the latching timing, differently from the conventional drive circuit. Consequently, there is provided a drive circuit for an electro-optical device, which enables the high-speed input of image data to an electro-optical device from an external circuit at a high speed and lowers the driving ability of the IC for inputting image data and reduces the power consumption thereof.

Moreover, according to the present invention, a liquid crystal drive circuit having a D/A converter is configured so that a pair of shift registers for latching image data is provided corresponding to each of bits of the image data, that the image data is latched from an external circuit to one of the shift registers of such a pair, image data of one line latched into the other shift register is simultaneously transferred to the D/A converter, and that a transferring switch for enabling this transfer of such image data is placed between the shift register provided corresponding to each of the bits.

Thus, there is provided a drive circuit for an electro-optical device, which sets the wiring pitch of signal lines in a pixel area at a smaller value, as compared with the case of placing all of the transferring switches at the D/A-converter side.

Furthermore, a delaying shift register is provided in addition to the pair of shift registers corresponding to each of the bits. Moreover, an on-off switch for enabling and/or disabling the transfer of image data is provided between this delaying shift register and an image data input terminal. An on-off switch for enabling and/or disabling the transfer of image data and a changing switch for permitting the transfer of image data to one of the shift registers of this pair are provided between the delaying shift register and another pair of shift registers.

Thus, the switches are controlled to thereby cause the delaying register to operate. Consequently, the lateral inversion of an image can be enabled only by a drive circuit of the present invention without providing what is called a reverse reading circuit, which is used for reading image data of one line from a memory storing the image data in a reverse direction, in an electro-optical device having the function of performing the lateral inversion of an image.

BRIEF DESCRIPTION OF THE DRAWINGS

Other features, objects and advantages of the present invention will become apparent from the following description of preferred embodiments with reference to the drawings in which like reference characters designate like or corresponding parts throughout several views, and in which:

FIG. 1 is a circuit diagram showing the configuration of a first embodiment of a drive circuit for a liquid crystal display device according to the present invention;

FIG. 2 is a timing chart illustrating the operation timing of a signal line drive circuit shown in FIG. 1;

FIG. 3 is a circuit diagram showing the configuration of a practical example of a logic circuit of a shift register provided in the signal line drive circuit shown in FIG. 1;

FIG. 4 is a timing chart illustrating the operation timing of the shift register shown in FIG. 3;

FIG. 5 is a circuit diagram showing the configuration of a second embodiment of a drive circuit for a liquid crystal display device according to the present invention;

FIGS. 6(A) and 6(B) are diagrams illustrating the function of a signal line drive circuit of the embodiment shown in FIG. 5;

FIG. 7 is a timing chart illustrating the operation timing of a signal line drive circuit of the embodiment shown in FIG. 5;

FIG. 8 is a circuit diagram showing the configuration of a third embodiment of a drive circuit for a liquid crystal display device according to the present invention;

FIG. 9 is a circuit diagram showing the configuration of a fourth embodiment of a drive circuit for a liquid crystal display device according to the present invention;

FIG. 10 is a circuit diagram showing the configuration of an example of a conventional drive circuit for a liquid crystal display device;

FIG. 11 is a diagram illustrating an embodiment of a liquid crystal display device of the present invention;

FIG. 12 is a diagram illustrating a portable computer that is an embodiment of electronic equipment of the present invention; and FIG. 13 is a diagram illustrating a projector that is another embodiment of electronic equipment of the present invention.

DETAILED DESCRIPTION OF PREFERRED EMBODIMENTS

FIG. 1 is a circuit diagram showing the configuration of a first embodiment of a drive circuit for a liquid crystal panel according to the present invention. In this figure, reference numeral 10 designates a pixel area in which a plurality of pixel elements each consisting of a pixel electrode and a TFT are placed in a matrix-like manner. Reference numeral 20 denotes what is called an X-system, namely, a signal line drive circuit for driving signal lines 11. Reference numeral 30 designates a scanning line drive circuit for selecting scanning lines 12 in turn. In this embodiment, the aforementioned signal line drive circuit 20 is constructed to drive signal lines for 3-bit (or 8-gray scale) digital image data. Incidentally, the present invention is not limited to this signal line drive circuit 20. Further, pairs of shift registers XSR1-0, XSR2-0; XSR1-1 XSR2-1; and XSR1-2, XSR2-2 are provided in the circuit 20 corresponding to input terminals D0, D1 and D2 through which the bits of image data supplied from an external control device are inputted, respectively.

Reference characters DAC1 to DACn designate 3-bit D/A converters provided in such a manner as to respectively correspond to the signal lines 11 drawn in the pixel area 10. In this embodiment, each pair of switches SW1-0, SW2-0; SW1-1, SW2-1; SW1-2, SW2-2 for switching and transferring data are provided between a corresponding pair of shift registers XSR1-0, XSR2-0; XSR1-1 XSR2-1; and XSR1-2, XSR2-2 and the corresponding ones of the D/A converters DAC1 to DACn. The states of these switches are changed according to a switching control signal LAT supplied from the external control device. Thus, 1-bit image data is supplied from one of the shift registers XSR1-0, XSR2-0; XSR1-1, XSR2-1; and XSR1-2, XSR2-2 of each of the pairs, namely, image data composed of a total of 3 bits are supplied therefrom to the D/A converters DAC1 to DACn, whereupon the image data are D/A-converted. Then, voltages respectively corresponding to 8 gray scales are generated and supplied to the corresponding signal lines 11.

Further, each of the pairs of shift registers XSR1-0, XSR2-0; XSR1-1, XSR2-1; and XSR1-2, XSR2-2 is connected to the image data input terminals D0, D1 and D2. The shift registers XSR1-0, XSR1-1 and XSR1-2 are caused according to the clock signals CLK1 and $\overline{\text{CLK1}}$ supplied from the external control device to latch the data and perform shifting operations. Moreover, the shift registers XSR2-0, XSR2-1 and XSR2-2 are caused according to the clock signals CLK2 and $\overline{\text{CLK2}}$ to latch the data and perform shifting operations. Thus, each of these shift registers operate in such a way as to sequentially latch the image data bit by bit from the image data input terminals D0, D1 and D2 and then shift the data in a reverse direction.

As shown in FIG. 1, among the switches for controlling data transfer between the shift registers XSR1-0, XSR2-0; XSR1-1 XSR2-1; and XSR1-2, XSR2-2 and the D/A converters DAC1 to DACn, the switches SW1-0, SW2-0 are provided between the shift registers XSR2-0 and XSR1-1, while the switches SW1-1 and SW2-1 are provided between the shift registers XSR2-1 and XSR1-2. Although these switches may be placed between the shift register XSR2-2 and each of the D/A converters DAC1 to DACn, these switches are provided between the shift registers as described above. Thus, the wiring pitch of the signal lines in the pixel area can be made to be small, as compared with that of the signal lines in the case of placing these switches at the side of the D/A converters. Consequently, this embodiment has an advantage in that the pixel area can be highly integrated.

Moreover, even when the pixel area and the drive circuit are formed on a substrate, it is preferable that the image data input terminals D0, D1 and D2 are positioned at the right side of the substrate corresponding to the circuit of FIG. 1, as viewed in this figure. Generally, in the case of the conventional drive circuit, the image data input terminals are placed at the left side of the substrate, and the data are shifted in a direction from the shift register, which is closest to the input terminals, to the shift register that is most distant therefrom. It is, thus, necessary for the external control device to perform the reverse reading of image data when image data of 1 line is read from a memory storing the image data. In contrast, this embodiment eliminates the necessity for the reverse reading of image data by placing the image data input terminals at the right side of the substrate. Thus, this embodiment has an advantage in that the method of reading image data from the memory is simplified.

Next, an operation of the aforementioned signal line drive circuit 20 will be described hereinbelow by referring to a timing chart of FIG. 2. First, 3-bit image data VD0, VD1 and VD2 are sequentially inputted in parallel to the image data input terminals D0, D1 and D2 from the control device placed outside or the like. Moreover, clock signals CLK1, $\overline{\text{CLK1}}$ or CLK2, $\overline{\text{CLK2}}$ synchronized with the aforementioned image data VD0, VD1 and VD2 are input to the signal line drive circuit 20. In this embodiment, the signal level of a switching control signal LAT supplied from the external control device is changed between high and low levels every input of image data of 1 line. Furthermore, each pair of the clock signals (CLK1, $\overline{\text{CLK1}}$) or (CLK2, $\overline{\text{CLK2}}$) is generated in response to the switching control signal LAT so that when one of the pairs of the clock signals is being input, the inputting of the other pair of the clock signals is halted.

Thus, when the switching control signal LAT is at the low level, the input image data VD0, VD1 and VD2 are sequentially latched by a set of the shift registers XSR1-0, XSR1-1 and XSR1-2 in response to the clock signals CLK1 and $\overline{\text{CLK1}}$, and then shifted therein. In contrast, when the switching control signal LAT is at the high level, the inputted image data VD0, VD1 and VD2 are sequentially latched by the other set of the shift registers XSR2-0, XSR2-1 and XSR2-2 in response to the clock signals CLK2 and $\overline{\text{CLK2}}$, and then shifted therein.

Further, when one of the sets of the shift registers XSR1-0, XSR1-1 and XSR1-2 latch image data (namely, the switching control signal LAT is at the low level) by controlling the switching control switches SW1-0 to SW2-2 according to the switching control signal LAT, image data latched by the other set of the shift registers XSR2-0, XSR2-1 and XSR2-2 is transferred to the D/A converters DAC1 to DACn. Conversely, when the latter set of the shift registers XSR2-0, XSR2-1 and XSR2-2 latch image data (namely, the switching control signal LAT is at the high level), the image data latched by the former set of the shift registers XSR1-0, XSR1-1 and XSR1-2 is transferred to the D/A converters DAC1 to DACn. As a result of repeatedly performing this process, voltage signals obtained by D/A-converting image data of one screen are successively supplied to the signal lines 11 in the pixel area 10.

Incidentally, the scanning lines 12 are driven in turn by a scanning-line-side (namely, a Y-system) drive circuit (not shown) to a selection level (namely, the high level) in synchronization with a change in the output of each of the D/A converters DAC1 to DACn in the pixel area 10. Then, a TFT corresponding to each pixel element connected to the selected scanning line is turned on. Further, a voltage of the signal line 11 is applied to a corresponding pixel electrode.

FIG. 3 shows a more practical example of the shift register XSR of the signal line drive circuit 20 of FIG. 1. Further, FIG. 4 illustrates an operation of this shift register. Incidentally, FIG. 3 shows 10 stages of the signal line drive circuit of FIG. 1. FIG. 4 illustrates the operation timing in the case that 6-bit data is latched by the 10 stages of the shift register. As illustrated in FIG. 3, one stage of the shift register XSR comprises an inputting clocked inverter for inputting signals, and a latch circuit constituted by a pair of inverters respectively having an input terminal and an output terminal, which are connected to each other. The feedback inverter of this latch circuit is constituted as a clocked inverter, and is operated according to a clock of a phase opposite to the phase of a clock corresponding to the other inverter thereof inputting signals. Further, the inputting inverters of odd-numbered stages of the latch circuit are operated by the same clock CLK1. Moreover, the inputting inverters of even-numbered stages of the latch circuit are operated according to the same clock $\overline{\text{CLK1}}$ having a phase opposite to the phase of the clock CLK1.

According to the shift register of the aforementioned configuration, the length of the data line between the image data input terminal and the shift register for latching image data is short. Thus, this embodiment eliminates the necessity for considering the timing margin of the clock providing the first group of latch circuit with the latching timing. Consequently, it is possible for this embodiment to input image data at a high speed from an external circuit thereto. Moreover, in the case of the signal line drive circuit of the aforementioned embodiment, lines for supplying clock signals are longer than the data lines L0, L1 and L2, differently from the conventional signal line drive circuit of FIG. 10. However, as is apparent from FIG. 2, the frequency of the clock signal is half the frequency of a signal representing image data. Thus, in the case of inputting clock signals, the degree of necessity for high-speed input capability is not high, as compared with the case of inputting image data. It is, therefore, unnecessary that the degree of enhancing the driving ability of the IC (or controller) outputting image data and clocks is not high, differently from the case of using the signal line drive circuit of FIG. 10. Consequently, the power consumption of the drive circuit and the cost of the IC can be prevented from increasing.

FIG. 5 is a circuit diagram showing the configuration of a second embodiment of the signal line drive circuit for a liquid crystal display device according to the present invention. The signal line drive circuit of this embodiment has a configuration for facilitating the lateral inversion of a display of an image, and is constructed as a signal line drive circuit for 3-bit image data, similar to the signal line drive circuit of the first embodiment of FIG. 1. Namely, the signal line drive circuit of the second embodiment has delay shift registers XSR3-0, XSR3-1 and XSR3-2 corresponding to the input terminals D0, D1 and D2 for inputting the bits of image data supplied from the external control device, in addition to the shift registers XSR1-0, XSR2-0; XSR1-1, XSR2-1; and XSR1-2, XSR2-2.

Even in the second embodiment, among the switches for controlling data transfer between the shift registers XSR1-0, XSR2-0; XSR1-1, XSR2-1; and XSR1-2, XSR2-2 and the D/A converters DAC1 to DACn, the switches SW1-0 and SW2-0 are provided between the shift registers XSR2-0 and XSR1-1, while the switches SW1-1 and SW2-1 are provided between the shift registers XSR2-1 and XSR1-2.

Further, in the signal line drive circuit of the second embodiment, switches SW11, SW12 and SW13 for enabling and disabling data transfer are respectively provided between the delay shift register XSR3-0 and the image data input terminal D0, between the delay shift register XSR3-1 and the image data input terminal D1 and between the delay shift register XSR3-2 and the image data input terminal D2. Furthermore, the switches SW21, SW22 and SW23 for enabling and disabling data transfer are respectively provided between the delay shift register XSR3-0 and a pair of the shift registers XSR1-0 and XSR2-0, between the delay shift register XSR3-1 and a pair of the shift registers XSR1-1 and XSR2-1 and between the delay shift register XSR3-2 and a pair of the shift registers XSR1-2 and XSR2-2. Moreover, the switches SW31, SW32 and SW33 for enabling data transfer between the corresponding input terminal and one of the shift registers of each of these pairs are respectively provided between the delay shift register XSR3-0 and the pair of the shift registers XSR1-0 and XSR2-0, between the delay shift register XSR3-1 and the pair of the shift registers XSR1-1 and XSR2-1 and between the delay shift register XSR3-2 and the pair of the shift registers XSR1-2 and XSR2-2.

Furthermore, in the second embodiment, each of switches SW41, SW42, SW43 and SW44 for enabling and disabling the supplying of shift clocks CLK, $\overline{CLK}$ is provided between the corresponding clock input terminal and the corresponding one of the shift registers XSR1-0, XSR2-0; XSR1-1, XSR2-1; and XSR1-2, XSR2-2. The switches SW41, SW42, SW43 and SW44 are configured in such a manner as to be enabled and disabled according to switch control signals CSW and $\overline{CSW}$, which are supplied from the external control device, in a complementary manner.

When the clocks CLK and $\overline{CLK}$ are supplied to the shift registers XSR1-0, XSR1-1 and XSR1-2 through the switch SW41, SW42; SW43, SW44, the supplying of the clocks to the shift registers XSR2-0, XSR2-1 and XSR2-2 is interrupted. Conversely, when the clocks CLK and $\overline{CLK}$ are supplied to the shift registers XSR2-0, XSR2-1 and XSR2-2, the supplying of the clocks to the shift registers XSR1-0, XSR1-1 and XSR1-2 is interrupted. On the other hand, the clocks CLK and $\overline{CLK}$ can be always supplied to the delay shift registers XSR3-0, XSR3-1 and XSR3-2.

Furthermore, the switches SW11, SW12, SW13, SW21, SW22 and SW23 are adapted to be simultaneously controlled according to control signals R/L supplied from the external control device in such a way as to be brought into an on-state or off-state. Further, regarding the shift registers XSR1-0, XSR2-0; XSR1-1, XSR2-1; and XSR1-2, XSR2-2, the direction, in which data is shifted, is controlled by this control signal R/L. When the switches SW11 to SW23 are turned off, a shifting operation is performed on the registers in a direction from the right to the left, as viewed in this figure, similarly as in the case of the first embodiment. Conversely, when the switches SW11 to SW23 are turned on, the shifting operation is performed on the registers in a direction from the left to the right.

Next, an operation of the shift register of the signal line drive circuit of the second embodiment will be described hereunder by referring to FIG. 6. When the lateral inversion of a display of an image is performed, the switches SW11, SW12 and SW13 provided between the aforementioned delay shift registers XSR3-0, XSR3-1, XSR3-2 and the image data input terminals D0, D1 and D2 are turned on. Moreover, the switches SW21, SW22 and SW23 provided between the delay shift registers XSR3-0, XSR3-1, XSR3-2 and the shift registers XSR1-0, XSR2-0; XSR1-1, XSR2-1; and XSR1-2, XSR2-2 are turned on.

FIG. 6(A) illustrates such an operation of the shift registers XSR1-0, XSR2-0 and XSR3-0. Incidentally, the switch SW31 (or SW32 or SW33) is closed in such a way as to connect data to the shift register XSR2-0 (or XSR2-1 or XSR2-2). Upon completion of transfer of data of 1 line, the switch SW11 (or SW12 or SW13) and SW21 (or SW22 or SW23) remain turned on, while the switch SW31 is closed in such a manner as to connect data to the shift register XSR3-0 (or XSR1-1 or XSR1-2). As illustrated in FIG. 6(A), image data inputted from the input terminal D0 (or D1 or D2) are latched sequentially by the shift register XSR3-0 (or XSR3-1 or XSR3-2). Then, the image data are transferred to the shift register XSR1-0 or XSR2-0 (or XSR1-1 or XSR2-1; XSR1-2 or XSR2-2), and shifted in a direction (namely, from the left to the right as viewed in this figure) opposite to the direction in which the image data are shifted in the first embodiment of FIG. 1. Thus, the inversion of a display of an image can be achieved without changing the order in which image data representing the image is read from a memory having stored the image data.

Incidentally, when the displaying of an image is performed without conducting the lateral inversion thereof, similarly as in the case of the first embodiment, it is sufficient that the switch SW11 (or SW12 or SW13), which is provided between the delay shift register XSR3-0 (or XSR3-1 or XSR3-2) and the input terminal D0 (or D1 or D2), and the switch SW21 (or SW22 or SW23), which is provided between the delay shift register XSR3-0 (or XSR3-1 or XSR3-2) and a pair of shift registers XSR1-0, XSR2-0 (or XSR1-1, XSR2-1; or XSR1-2, XSR2-2) are turned off, as illustrated in FIG. 6(B), and that the image data is latched by the shift register XSR1-0 or XSR2-0 (or XSR1-1 or XSR2-1; or XSR1-2, XSR2-2).

In the case of a conventional electro-optical device, when the lateral inversion of a display of an image is performed, an external control device needs to change a direction, in which image data is read, by using software. Thus, the conventional electro-optical device has a drawback in that a heavy load is put on the software. However, as a result of applying the signal line drive circuit to the device, the control device has only to generate the signal R/L for controlling the switches SW11 to SW23. Consequently, this embodiment has an advantage in that the load put on the software is considerably lightened.

FIG. 7 illustrates the operation timing of the signal line drive circuit of the embodiment of FIG. 5. As is obvious from the comparison between FIGS. 7 and 2, the signal line drive circuit of the embodiment of FIG. 5 has an advantage in that operations of the shift registers need only one kind of clocks. This is because the signal line drive circuit is controlled in the following manner. Namely, when the clocks CLK, $\overline{CLK}$ are supplied to the shift registers XSR1-0, XSR1-1 and XSR1-2 by using the switches SW41, SW42; and SW43, SW44 for changing the supplying of the clocks, the supplying of clocks to the shift registers XSR2-0, XSR2-1 and XSR2-2 is interrupted. Conversely, when the clocks CLK, $\overline{CLK}$ are supplied to the shift registers XSR2-0, XSR2-1 and XSR2-2, the supplying of clocks to the shift registers XSR1-0, XSR1-1 and XSR1-2 is interrupted. The signal LAT for controlling the data switching/transferring switches SW1-0, SW2-0; SW1-1, SW2-1; SW1-2, SW2-2 may be also used as the signal SW (or $\overline{SW}$) for controlling the switches SW41, SW42; SW43, SW44.

FIG. 8 shows another embodiment of the signal line drive circuit of the present invention. This embodiment is a modification of the signal line drive circuit of the embodiment illustrated in FIG. 1. Namely, the shift registers XSR2-0, XSR2-1 and XSR2-2 of the embodiment of FIG. 1 are replaced with register XLT1-2, XLT2-2 and XLT3-2 that do not have the shifting function. Moreover, the switches SW1-0, SW2-0; SW1-1, SW2-1; SW1-2 and SW2-2 for switching data are provided between the shift registers XSR1-0, XSR2-0; XSR1-1, XSR2-1; XSR1-2, XSR2-2 and the D/A converters DAC1 to DACn in the embodiment of FIG. 1, while such switches are provided between the shift registers XSR1-1, XSR2-1 and XSR3-1 and the registers XLT1-2, XLT2-2 and XLT3-2 in the second embodiment.

As described above, the second embodiment has the advantage in that the circuit uses only one kind of clock signals for shifting data. However, during the data latched by the shift registers XSR1-1, XSR2-1 and XSR3-1 is transferred to the registers XLT1-2, XLT2-2 and XLT3-2, these shift registers cannot latch new image data. Thus, the latching timing should be changed.

FIG. 9 shows still another embodiment of the signal line drive circuit of the present invention. This embodiment is a modification of the signal line drive circuit of the embodiment of FIG. 5, which is obtained in a manner similar to the way in the case of changing the signal line drive circuit of the embodiment of FIG. 1 to that of the embodiment of FIG. 8. Namely, the shift registers XSR1-2, XSR2-2 and XSR3-2 of the embodiment of FIG. 5 are replaced with the simple registers XLT1-2, XLT2-2 and XLT3-2, respectively. Moreover, the switches SW1-0, SW2-0; SW1-1, SW2-1; SW1-2 and SW2-2 for switching data are provided between the shift registers ZSR1-1, XSR2-1 and XSR3-1 and the registers XLT1-2, XLT2-2 and XLT3-2 in this embodiment, differently from the first embodiment of FIG. 1 in which such switches are provided between the shift registers XSR1-0, XSR2-0; XSR1-1, XSR2-1; XSR1-2, XSR2-2 and the D/A converters DAC1 to DACn in the embodiment of FIG. 1.

The embodiment of FIG. 9 has an advantage in that the number of switches and the number of kinds of control signals are reduced, as compared with the embodiment of FIG. 5. However, during the data latched by the shift registers XSR1-1, XSR2-1 and XSR3-1 is transferred to the registers XLT1-2, XLT2-2 and XLT3-2, these shift registers cannot latch new image data. Thus, the latching timing should be changed, similarly as in the case of the embodiment of FIG. 8.

Although the embodiments of the signal line drive circuit of the present invention in the case of using 3-bit image data have been described above, it should be understood that the present invention is not limited thereto. For example, in the case that the image data is 6-bit data or other single-bit or multi-bit data, the present invention can be applied to the signal line drive circuit. Namely, it is sufficient for the drive circuit to have shift registers of sets of the number that is equal to the number of bits composing the image data.

Next, embodiments of electronic equipment, such as an electro-optical device having a liquid crystal panel substrate using the aforementioned signal line drive circuit, and a portable computer or a liquid crystal projector, which has this electro-optical device, will be described hereinbelow.

As illustrated in FIG. 11, a liquid crystal display device 850 serving as an electro-optical device is constructed by stacking backlights 851, a polarizer 852, a liquid crystal panel substrate (or a TFT substrate) 853, a liquid crystal 854, a counter substrate 855 having a counter electrode and a color filter, and a polarizer 856 in this order. In this embodiment, as described above, a pixel area and the drive circuit 878 of the aforementioned embodiment are formed on a TFT substrate 853.

As illustrated in FIG. 12, a portable computer 860 has a main unit portion 862, which has a keyboard 861, and a liquid crystal display screen 863.

As illustrated in FIG. 13, a liquid crystal projector 870 is a projector that employs a transparent liquid crystal panel as a light valve. This liquid crystal projector 870 has, for example, a triple prism type optical system. In the projector 870 of FIG. 13, projection light irradiated from a lamp unit 871 serving as a white light source is divided by a plurality of mirrors 873 and two dichroic mirrors 874 into component light rays respectively corresponding to primary colors R, G and B in a light guide 872. Such light components are directed to three liquid crystal panels 875, 876 and 877 respectively displaying images of such colors. Then, the component light rays modulated by the liquid crystal panels 875, 876 and 877 are incident on a dichroic prism 878 from three directions. In the dichroic prism 878, the component light rays respectively corresponding to R (red) component light and B (blue) component light are deflected by 90 degrees. On the other hand, G (green) component light travels rectilinearly. A color image is obtained by synthesizing images of such colors and projected on a screen through a projection lens.

Additionally, examples of electronic equipment, to which the present invention can be applied, are an engineering workstation, a pager or a portable telephone, a word processor, a television set, a viewfinder type or direct-view-type camcorder, an electronic pocket notebook, an electronic desk calculator, a car navigation device, a POS (point-of-service) terminal and various devices each having a touch panel.

As described above, the drive circuit of the present invention is configured so that a shift register is used as a circuit for latching image data input from an external circuit. Thus, the length of data lines between an input terminal for inputting image data and a shift register for latching the image data is reduced. Further, in the case of the drive circuit of the present invention, there is no need for considering the timing margin of clocks providing each of latch circuits with the latching timing, differently from the conventional drive circuit. Consequently, image data is input thereto from the external circuit at a high speed. Moreover, the present invention has advantageous effects in that the present invention provides a drive circuit for a liquid crystal display device, which can lower the driving ability of an IC for inputting image data and decrease the power consumption thereof.

Although the preferred embodiments of the present invention have been described above, it should be understood that the present invention is not limited thereto and that other modifications will be apparent to those skilled in the art without departing from the spirit of the invention.

The scope of the present invention, therefore, should be determined solely by the appended claims.

What is claimed is:

1. A drive circuit for an electro-optical device, to which N-bit digital image data is input (N is a positive integer), said drive circuit converting the digital image data to a voltage signal corresponding to one of $2^N$ gray scales and supply the voltage signal to a signal line, comprising:

a plurality of pairs of shift registers that latch signals respectively representing bits of the image data and for holding the latched signals;

a D/A converter that performs D/A conversion of the image data latched by said shift registers N-bits by N-bits, to generate voltage signals corresponding to $2^N$ gray scales and to supply the voltage signals to a signal line; and a switch group that selectively supplies said D/A converter with the image data latched by one of the shift registers of each of the plurality of pairs of shift registers, said plurality of pairs of shift registers repeatedly and alternatively performing an operation of supplying said D/A converter with image data held by one of the shift registers of each of said plurality of pairs of shift registers when image data is latched by an other one of the shift registers.

2. The drive circuit for an electro-optical device according to claim 1, among switches of said switch group, switches other than a switch for transferring image data held by said shift register closest to said D/A converter being placed between said plurality of pairs of shift registers.

3. The drive circuit for an electro-optical device according to claim 1, further comprising:

a third shift register, provided corresponding to each of said plurality of pairs of shift registers, for latching image data; and switches provided between said third shift register and a digital image input terminal and between said third shift register and each of said plurality of pairs of shift registers, said plurality of pairs of shift registers repeatedly and alternately performing an operation of transferring image data to one of the shift registers of each of said plurality of pairs of shift registers after the image data to be transferred is latched by said third shift register from said input terminal by controlling said switches, and supplies said D/A converter with image data held by the other of the shift registers of a corresponding pair during the transferring of image data to the one of the shift registers.

4. The drive circuit for an electro-optical device according to claim 1, further comprising a switch for selectively supplying a shifting clock signal to each of said plurality of pairs of shift registers.

5. A liquid crystal panel substrate comprising:

a drive circuit, to which N-bit digital image data is input (N is a positive integer), said drive circuit converting the digital image data to a voltage signal corresponding to one of $2^N$ gray scales and supplying the voltage signal to a signal line, said drive circuit having:

a plurality of pairs of shift registers that latch signals respectively representing bits of the image data and for holding the latched signals;

a D/A converter that D/A-converts the image data latch by said shift registers N-bits by N-bits, to generate voltage signals corresponding to $2^N$ gray scales and to supply the voltage signals to a signal line; and a switch group that selectively supplies said D/A converter with the image data latched by one of the shift registers of each of the plurality of pairs of shift registers, said plurality of pairs of shift registers repeatedly and alternately performing an operation of supplying said D/A converter with image data held by one of the shift registers of each of said plurality of pairs of shift registers when image data is latched by an other one of the shift registers; and a pixel area having:

a plurality of pixel electrodes;

signal lines that supply voltages to be applied to said plurality of pixel electrodes; and scanning lines for selecting pixels to which the voltages are applied, said drive circuit supplying said signal lines with voltages respectively corresponding to image data.

6. The liquid crystal panel substrate according to claim 5, among switches of said switch group, switches other than a switch for transferring image data held by said shift register closest to said D/A converter being placed between said plurality of pairs of shift registers.

7. The liquid crystal panel substrate according to claim 5, further comprising:

a third shift register, provided corresponding to each of said plurality of pairs of shift registers, for latching image data; and switches provided between said third shift register and a digital image input terminal and between said third shift register and each of said plurality of pairs of shift registers, said plurality of pairs of shift registers repeatedly and alternately performing an operation of transferring image data to one of the shift registers of each of said plurality of pairs of shift registers after the image data to be transferred is latched by said third shift register from said input terminal by controlling said switches, and supplies said D/A converter with image data held by the other of the shift registers of a corresponding pair during the transferring of image data to the one of the shift registers.

8. The liquid crystal panel substrate according to claim 5, further comprising a switch for selectively supplying a shifting clock signal to each of said plurality of pairs of shift registers.

9. A liquid crystal device comprising:

a liquid crystal panel substrate having:

a drive circuit, to which N-bit digital image data is input (N is a positive integer), said drive circuit converting the digital image data to a voltage signal corresponding to one of $2^N$ gray scales and supplying the voltage signal to a signal line, said drive circuit having:

a plurality of pairs of shift registers that latch signals respectively representing bits of the image data and for holding the latched signals;

a D/A converter that D/A-converts the image data latched by said shift registers N-bits by N-bits, to generate voltage signals corresponding to $2^N$ gray scales and to supply the voltage signals to a signal line; and a switch group that selectively supplies said D/A converter with the image data latched by one of the shift registers of each of the plurality of pairs of shift registers, said plurality of pairs of shift registers repeatedly and alternately performing an operation of supplying said D/A converter with image data held by one of the shift registers of each of said plurality of pairs of shift registers when image data is latched by an other one of the shift registers; and a pixel area having:

a plurality of pixel electrodes;

signal lines that supply voltages to be applied to said plurality of pixel electrodes; and scanning lines for selecting pixels to which the voltages are applied, said drive circuit supplying said signal lines with voltages respectively corresponding to image data; and a transparent substrate having a counter electrode, said liquid crystal panel substrate and said transparent substrate being placed at a distance from each other, and a gap between said liquid crystal panel substrate and said transparent substrate being filled with liquid crystal.

10. The liquid crystal device according to claim 9, among switches of said switch group, switches other than a switch for transferring image data held by said shift register closest to said D/A converter being placed between said plurality of pairs of shift registers.

11. The liquid crystal device according to claim 9, further comprising:

a third shift register, provided corresponding to each of said plurality of pairs of shift registers, for latching image data; and switches provided between said third shift register and a digital image input terminal and between said third shift register and each of said plurality of pairs of shift registers, said plurality of pairs of shift registers repeatedly and alternately performing an operation of transferring image data to one of the shift registers of each of said plurality of pairs of shift registers after the image data to be transferred is latched by said third shift register from said input terminal by controlling said switches, and supplies said D/A converter with image data held by the other of the shift registers of a corresponding pair during the transferring of image data to the one of the shift registers.

12. The liquid crystal device according to claim 9, further comprising a switch for selectively supplying a shifting clock signal to each of said plurality of pairs of shift registers.

13. A projection display device, comprising:

a light source;

a liquid crystal panel; and a projection optical device that collects light modulated by said liquid crystal panel and projecting the modulated light in an enlarged manner, said liquid crystal panel including:

a liquid crystal panel substrate having:

a drive circuit, to which N-bit digital image data is input (N is a positive integer), said drive circuit converting the digital image data to a voltage signal corresponding to one of $2^N$ gray scales and supplying the voltage signal to a signal line, said drive circuit having:

a plurality of pairs of shift registers that latch signals respectively representing bits of the image data and for holding the latched signals;

a D/A converter that D/A-converts the image data latched by said shift registers N-bits by N-bits, to generate voltage signals corresponding to $2^N$ gray scales and to supply the voltage signals to a signal line; and a switch group that selectively supplies said D/A converter with the image data latched by one of the shift registers of each of the plurality of pairs of shift registers, said plurality of pairs of shift registers repeatedly and alternately performing an operation of supplying said D/A converter with image data held by one of the shift registers of each of said plurality of pairs of shift registers when image data is latched by an other one of the shift registers; and a pixel area having:

a plurality of pixel electrodes;

signal lines that supply voltages to be applied to said plurality of pixel electrodes; and scanning lines for selecting pixels to which the voltages are applied, said drive circuit supplying said signal lines with voltages respectively corresponding to image data; and a transparent substrate having a counter electrode, said liquid crystal panel substrate and said transparent substrate being placed at a distance from each other, and a gap between said liquid crystal panel substrate and said transparent substrate being filled with liquid crystal.

14. The projection display device according to claim 13, among switches of said switch group, switches other than a switch for transferring image data held by said shift register closest to said D/A converter being placed between said plurality of pairs of shift registers.

15. The projection display device according to claim 13, further comprising:

a third shift register, provided corresponding to each of said plurality of pairs of shift registers, for latching image data; and switches provided between said third shift register and a digital image input terminal and between said third shift register and each of said plurality of pairs of shift registers, said plurality of pairs of shift registers repeatedly and alternately performing an operation of transferring image data to one of the shift registers of each of said plurality of pairs of shift registers after the image data to be transferred is latched by said third shift register from said input terminal by controlling said switches, and supplies said D/A converter with image data held by the other of the shift registers of a corresponding pair during the transferring of image data to the one of the shift registers.

16. The projection display device according to claim 13 further comprising a switch for selectively supplying a shifting clock signal to each of said plurality of pairs of shift registers.

17. An electro-optical device having a liquid crystal panel for displaying an image thereon, said liquid crystal panel comprising:

a liquid crystal panel substrate having:

a drive circuit, to which N-bit digital image data is input (N is a positive integer), said drive circuit converting the digital image data to a voltage signal corresponding to one of $2^N$ gray scales and supplying the voltage signal to a signal line, said drive circuit having:

a plurality of pairs of shift registers that latch signals respectively representing bits of the image data and for holding the latched signals;

a D/A converter that D/A-converts the image data latched by said shift registers N-bits by N-bits, to generate voltage signals corresponding to $2^N$ gray scales and to supply the voltage signals to a signal line; and a switch group that selectively supplies said D/A converter with the image data latched by one of the shift registers of each of the plurality of pairs of shift registers, said plurality of pairs of shift registers repeatedly and alternately performing an operation of supplying said D/A converter with image data held by one of the shift registers of each of said plurality of pairs of shift registers when image data is latched by an other on of the shift registers; and a pixel area having:

a plurality of pixel electrodes;

signal lines that supply voltages to be applied to said plurality of pixel electrodes; and scanning lines for selecting pixels to which the voltages are applied, said drive circuit supplying said signal lines with voltages respectively corresponding to image data; and a transparent substrate having a counter electrode, said liquid crystal panel substrate and said transparent substrate being placed at a distance from each other, and a gap between said liquid crystal panel substrate and said transparent substrate being filled with liquid crystal.

18. The electro-optical device according to claim 17, among switches of said switch group, switches other than a switch for transferring image data held by said shift register closest to said D/A converter being placed between said plurality of pairs of shift registers.

19. The electro-optical device according to claim 17, further comprising:

a third shift register, provided corresponding to each of said plurality of pairs of shift registers, for latching image data; and switches provided between said third shift register and a digital image input terminal and between said third shift register and each of said plurality of pairs of shift registers, said plurality of pairs of shift registers repeatedly and alternately performing an operation of transferring image data to one of the shift registers of each of said plurality of pairs of shift registers after the image data to be transferred is latched by said third shift register from said input terminal by controlling said switches, and supplies said D/A converter with image data held by the other of the shift registers of a corresponding pair during the transferring of image data to the one of the shift registers.

20. The electro-optical device according to claim 17 further comprising a switch for selectively supplying a shifting clock signal to each of said plurality of pairs of shift registers.

21. Electronic equipment including an electro-optical device, said electro-optical device having a liquid crystal panel for displaying an image thereon, said liquid crystal panel comprising:

a liquid crystal panel substrate having:

a drive circuit, to which N-bit digital image data is input (N is a positive integer), said drive circuit converting the digital image data to a voltage signal corresponding to one of $2^N$ gray scales and supplying the voltage signal to a signal line, said drive circuit having:

a plurality of pairs of shift registers that latch signals respectively representing bits of the image data and for holding the latched signals;

a D/A converter that D/A-converts the image data latched by said shift registers N-bits by N-bits, to generate voltage signals corresponding to $2^N$ gray scales and to supply the voltage signals to a signal line; and a switch group that selectively supplies said D/A converter with the image data latched by one of the shift registers of each of the plurality of pairs of shift registers, said plurality of pairs of shift registers repeatedly and alternately performing an operation of supplying said D/A converter with image data held by one of the shift registers of each of said plurality of pairs of shift registers when image data is latched by an other on of the shift registers; and a pixel area having:

a plurality of pixel electrodes;

signal lines that supply voltages to be applied to said plurality of pixel electrodes; and scanning lines for selecting pixels to which the voltages are applied, said drive circuit supplying said signal lines with voltages respectively corresponding to image data; and a transparent substrate having a counter electrode, said liquid crystal panel substrate and said transparent substrate being placed at a distance from each other, and a gap between said liquid crystal panel substrate and said transparent substrate being filled with liquid crystal.

22. The electronic equipment according to claim 21, among switches of said switch group, switches other than a switch for transferring image data held by said shift register closest to said D/A converter being placed between said plurality of pairs of shift registers.

23. The electronic equipment according to claim 21, further comprising:

a third shift register, provided corresponding to each of said plurality of pairs of shift registers, for latching image data; and switches provided between said third shift register and a digital image input terminal and between said third shift register and each of said plurality of pairs of shift registers, said plurality of pairs of shift registers repeatedly and alternately performing an operation of transferring image data to one of the shift registers of each of said plurality of pairs of shift registers after the image data to be transferred is latched by said third shift register from said input terminal by controlling said switches, and supplies said D/A converter with image data held by the other of the shift registers of a corresponding pair during the transferring of image data to the one of the shift registers.

24. The electronic equipment according to claim 21, further comprising a switch for selectively supplying a shifting clock signal to each of said plurality of pairs of shift registers.

* * * * *